US005845682A

United States Patent [19]

Hayao

[11] Patent Number: 5,845,682

[45] Date of Patent: Dec. 8, 1998

[54] APPARATUS FOR REFILLING AN INK CARTRIDGE

[75] Inventor: Sakae Hayao, Chatsworth, Calif.

[73] Assignee: Mitsubishi Pencil Corporation of America, Chatsworth, Calif.

[21] Appl. No.: 673,298

[22] Filed: Jun. 28, 1996

[51] Int. Cl.[6] ..... B67B 7/92

[52] U.S. Cl. ..... 141/18; 141/2; 141/329; 141/375; 225/1; 225/93; 225/103; 53/468; 347/86

[58] Field of Search ..... 141/2, 18, 21, 141/329, 106, 370, 375; 225/1, 93, 103; 53/468; 347/86, 87

[56] References Cited

U.S. PATENT DOCUMENTS

| | | | |
|---|---|---|---|
| 2,853,906 | 9/1958 | Pesta | 225/93 |
| 3,411,682 | 11/1968 | Leader et al. | 225/93 |
| 4,087,033 | 5/1978 | Domges et al. | 225/93 |
| 4,877,065 | 10/1989 | Lamboy et al. | 141/18 |
| 5,269,354 | 12/1993 | Koberg | 141/106 |
| 5,400,573 | 3/1995 | Crystal et al. | 53/468 |
| 5,479,968 | 1/1996 | Sanchez et al. | 141/2 |
| 5,495,877 | 3/1996 | Schwenk et al. | 141/370 |
| 5,546,830 | 8/1996 | Yuen | 225/103 |
| 5,581,287 | 12/1996 | Baezner et al. | 141/18 |
| 5,595,223 | 1/1997 | Hayao | 141/375 |
| 5,657,678 | 8/1997 | Cohen | 225/103 |

FOREIGN PATENT DOCUMENTS

| | | |
|---|---|---|
| 0603910 A1 | 6/1994 | European Pat. Off. . |
| 0704308 A1 | 4/1996 | European Pat. Off. . |
| 0709205 A2 | 5/1996 | European Pat. Off. . |
| 0771663 A2 | 5/1997 | European Pat. Off. . |
| 19648456 A1 | 5/1997 | Germany . |
| WO 97/15449 | 5/1997 | WIPO . |

*Primary Examiner*—J. Casimer Jacyna
*Attorney, Agent, or Firm*—Koda & Androlia

[57] ABSTRACT

An apparatus and method for refilling ink into a used, empty ink cartridge for ink-jet printers using an ink refill station and an ink refill adapter, the ink refill station accommodating the cartridge so that the head section of the cartridge is separated by a pressing or shearing force applied by a threaded screw that is provided in the refill station, and the ink refill adapter being placed on the main section of the cartridge after the head section is removed so that ink is transferred from an ink container to the main section of the cartridge via needles provided in the ink refill adapter.

15 Claims, 6 Drawing Sheets

APPARATUS FOR REFILLING AN INK CARTRIDGE

BACKGROUND OF THE INVENTION

1. Field of the Invention

The present invention relates to an apparatus for refilling an ink into an ink-cartridge and more particularly to an apparatus for refilling color inks into a used, empty color ink cartridge used for, for instance, ink-jet printers.

2. Prior Art

In order to protect the environment and save energy, it is today's common practice to reuse used printer ink cartridges. In other words, when an ink cartridge designed for use in computer printers, particularly in ink-jet printers, runs out of ink, it is refilled with ink so that the thus refilled ink cartridge is installed back in the printers. This practice is currently done not only for single color, usually black, ink cartridges but also for color ink cartridges.

FIG. 12 shows a typical color ink cartridge. The cartridge 1 is comprised of a main section 1*a* and a head section 1*b*. The head section 1*b* is attached to the main section 1*a* via welding, gluing, etc. at the flange 1*a*' and 1*b*' of the main section 1*a* and head section 1*b*'. The main section la contains inside thereof three ink reservoirs (not shown) for red, blue and yellow inks, respectively.

When this type of color ink cartridge is refilled with ink, holes are opened in the top surface of the head section 1*b* using a drill, for instance, so that ink is transferred from ink containers (bottles or tubes) into the cartridge 1 through the thus opened holes. Another way to refill the cartridge with ink is to remove the head section 1*b* from the main body 1*a*. When the head section 1*b* is separated as shown in FIG. 10, openings 2 of the ink reservoirs installed in the main section 1*b* of the cartridge 1 are exposed so that ink is transferred from ink containers (not shown) into the ink reservoirs. A vice is the most often used tool for removing the head section 1*b* from the main section 1*a*. The head section 1*b* can be removed using a principle of leverage which is seen in cap openers.

However, these devices for removing the head section 1*b* are used for only separating the head section 1*b* from the main section 1*a* and have no other use. In addition, when a drill is used for opening the ink transfer holes in the head section 1*b*, since the locations of the ink reservoirs in the main section 1*a* of the ink cartridge are not recognizable from the outside, hole making is not easy, thus making the refilling of ink difficult as a whole.

SUMMARY OF THE INVENTION

Accordingly, the object of the present invention is to provide an apparatus for refilling color ink cartridges that is free of the problems seen in conventional ink refilling apparatuses.

Another object of the present invention is to provide an apparatus which is used for refilling color ink cartridges with a simple structure.

Still another object of the present invention is to provide an apparatus for refilling color ink cartridges that can be used easily without contaminating the surrounding areas.

The above and other objects are accomplished by a unique structure for an ink refilling apparatus for refilling color inks into an empty color ink cartridge which comprises a combination of an ink refill station and an ink refill adapter; the refill station being substantially a rectangular box with open top and bottom ends and having an upwardly extended side plate which has a pushing screw, the ink refill adapter comprising a base plate which is provided with a plurality of ink container holders having ink transfer needles therein which connects ink containers to openings of the ink reservoirs provided in the main section of the ink cartridge.

With the structure above, an empty color ink cartridge with the ink therein completely used is set in the refill station with the head section of the cartridge positioned next to the upwardly extended side plate; then the pushing screw is turned so that the tip end of the pushing screw pushes the head section of the cartridge, thus separating the head section from the main section of the cartridge via the pressing force applied by the pushing screw. When the head section is thus removed, the ink cartridge or the main section of the cartridge remains inside the ink refill station, standing vertically; and the ink refill adapter is placed on the main section of the cartridge so that one end of each one of the ink transfer needles of the ink refill adapter is brought into the ink reservoir; and then the ink outlet of an ink container (or tube) is connected to another end of one of the ink transfer needles, thus transferring the ink from the ink containers into the ink reservoirs of the ink cartridge via the ink transfer needles.

The pushing screw can be provided in plural numbers so that the pressing force can be applied evenly on the head section of the ink cartridge.

DETAILED DESCRIPTION OF THE PREFERRED EMBODIMENTS

The ink refilling apparatus for refilling color inks into an empty color ink cartridge comprises an ink refill station 10 and an ink refill adapter 50.

Figure 1:
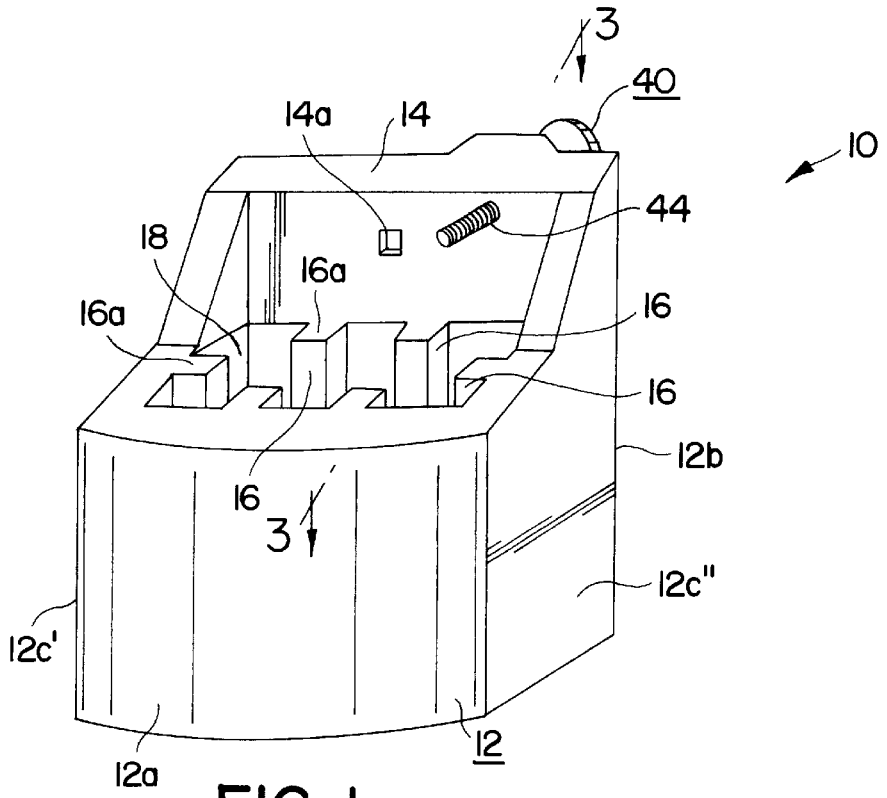
FIG. 1 is a perspective view of the ink refill station according to one embodiment of the present invention.

Typically, the ink refill station 10, as seen from FIG. 1, comprises a main box 12 having a rectangular shape when seen from above and an extended plate section 14, which are in a single unit and made of plastic, preferably transparent plastic.

The main box 12 includes a front wall 12*a*, a rear wall 12*b* and two side walls 12*c*" and 12*c*" that connects the front and rear walls 12*a* and 12*b* so as to form a box or container configuration with its top and bottom ends opened. These surrounding walls 12*a*, 12*b*, 12*c*' and 12*c*" have a height larger than the height h1 (see FIG. 12) of the main section 1*a* of the ink cartridge 1.

The extended plate section 14 of the rear wall 12*b* of the main box 12 is designed so as to be higher in FIG. 1 than the front and two side walls 12*a*, 12*c*' and 12*c*".

The main box 12 is provided with a plurality of longitudinal inner ribs 16 formed on the inner surfaces of the surrounding walls 12*a*, 12*b*, 12*c*' and 12*c*". In the main box 12 shown in FIG. 1, six (6) ribs 16 are provided, two on each of the front and rear walls and one on each of the side walls. There can be more than six ribs 16. For example, each of the front and rear walls 12*a* and 12*b* may have three (3) inner ribs 16 and each of the side walls 12*c*' and 12*c*" may have two (2) inner ribs 16 as seen from another embodiment of the present invention which is shown in FIG. 4 and described later.

Figure 2:
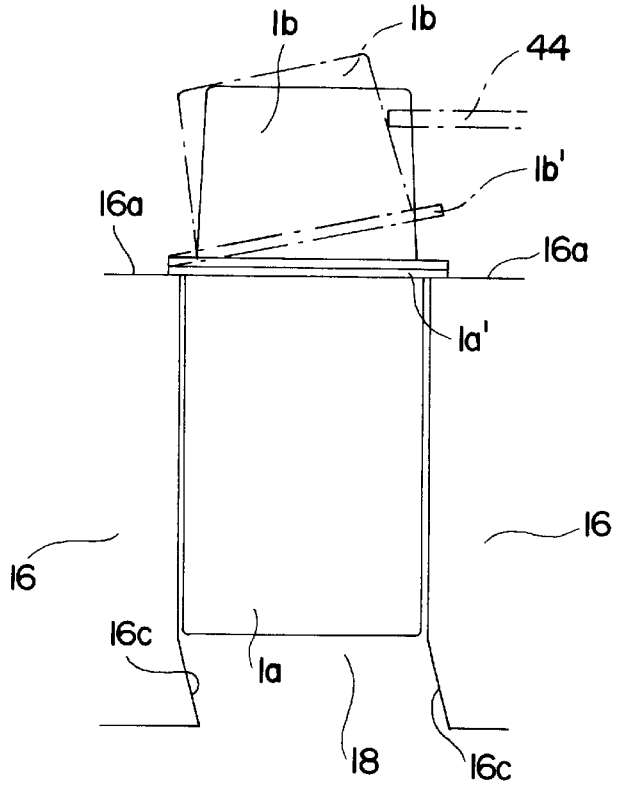
FIG. 2 is an schematic view showing the ink cartridge placed on the ribs of the ink refill station of FIG. 1.

These longitudinal ribs 16 extend along the inner surfaces of the front, rear and side walls 12*a*, 12*b*, 12*c*' and 12*c*" from the top to the bottom thereof so as to form a cartridge holding space 18 inside the main box 12. In addition, the ribs 16, as best seen from FIG. 2, are formed so that the flange 1*a*' formed on the outer upper edge of the main section 1*a* of the ink cartridge 1 can rest on the upper surfaces 16*a* of the ribs 16 and so that the main section 1*a* of the ink cartridge 1 is snugly received inside the cartridge holding space 18.

Figure 3:
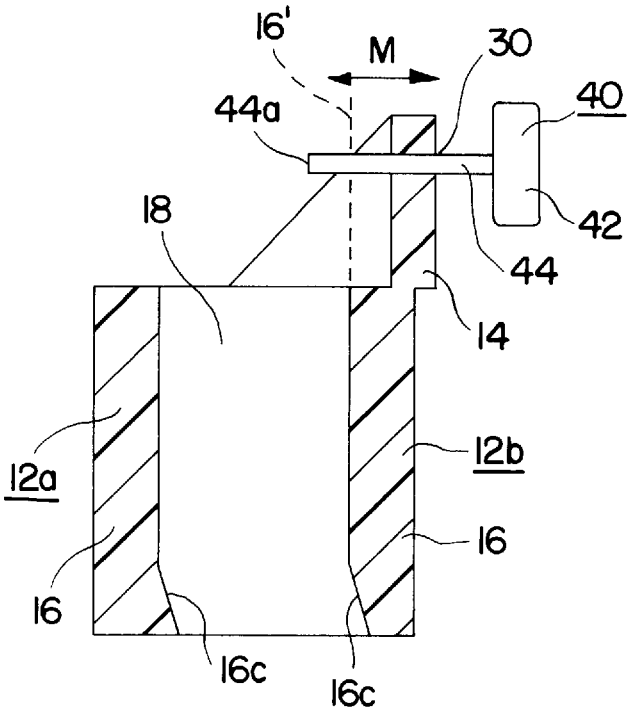
FIG. 3 shows a cross section taken along the line 3—3 in FIG. 1.

Furthermore, as shown in FIG. 3, the extended plate portion 14 of the rear wall 12*b* of the main box 12 is provided with a threaded hole 30 and a pushing screw 40 is screwed into the threaded hole 30. The pushing screw 40 comprises a head 42 and a shank 44 which has a screw thread formed thereon. The pushing screw 40 is disposed so that the shank 44 is positioned horizontally in the threaded hole 30. When the head 42 is rotated in one direction, the pushing screw 40 advances towards above the cartridge holding space 18 of the main box 12; and when the head 42 is rotated in another direction, the pushing screw 40 moves back and retreats towards the extended plate portion 14, as indicated by arrow M. The shank 44 has a length which, when rotated in one direction, can bring the tip end 44*a* thereof beyond the inner edge line 16' of the rib 16. The pushing screw 40 is provided so that the tip end 44*a* comes into contact with the upper end area of the upper section 1*b* of the cartridge 1 when the cartridge 1 is set in the ink refill station 10 as described later.

Figure 4:
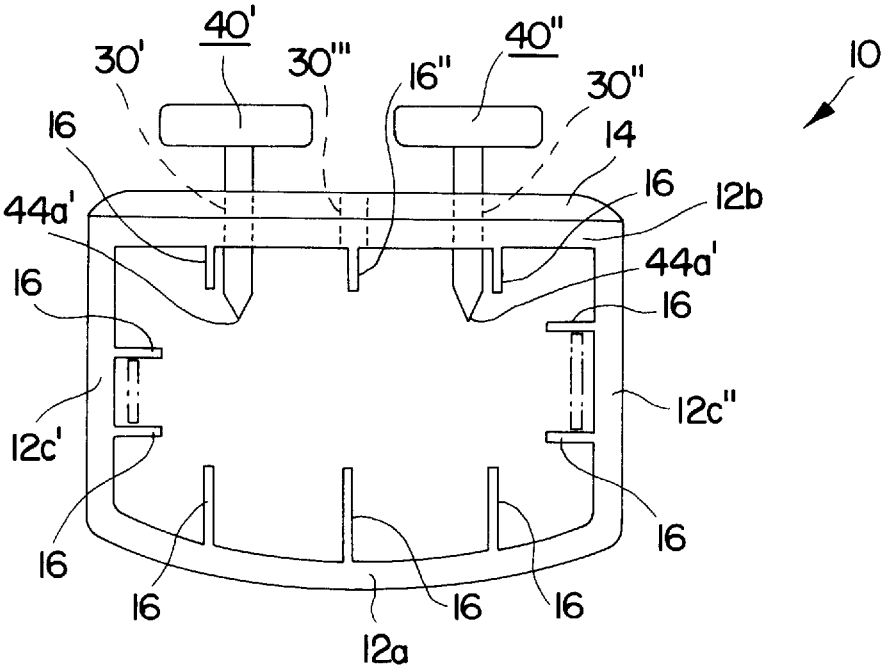
FIG. 4 is a top view of the ink refill station according to another embodiment of the present invention.

As seen from FIG. 4, which shows another type of ink refill station 10, the extended plate section 14 may have two threaded holes 30' and 30" so that a pair of pushing screws 40' and 40", each of which being substantially the same structure as the screw 40 shown in FIG. 3, are engaged with these threaded holes 30 of the extended plate section 14. In the ink refill station of FIG. 4, the main box 12 has a three (3) inner ribs 16 on the inner surfaces of the front and rear walls 12*a* and 12*b* , respectively, and two inner ribs 16 on each of the side walls 12*c*' and 12*c*". Though the space between two ribs 16 formed on the side wall 12*c*' is set to be smaller than the space between two ribs 16 formed on the side wall 12*c*", these spaces can be the same in the length.

Furthermore, the extended plate portion 14 of the main box 12 is, as shown in FIG. 1, provided with a positioning opening 14*a*. This positioning hole 14*a* is used for securely positioning the ink refill adapter 50 (described later) on the main box 12. Though not shown in the main box 12 in FIG. 4; the extended plate portion 14 of the main box 12 of FIG. 4 can be provided with a positioning opening.

In addition, as seen from FIG. 3, the lower end area of each one of the ribs 16 provided on the inner surfaces of the front and rear walls 12*a* and 12*b* has a slanted surface 16*c*. The slanted surfaces 16*c* formed on the ribs 16 of the inner surface of the front wall 12*a* and the slanted surfaces 16*c* formed on the ribs 16 of the inner surface of the rear wall 12*b* are parallel to each other, and the distance in between is set so as to be slightly larger than the width W (see FIG. 12) of the head section 1*b* of the cartridge 1.

Figure 5:
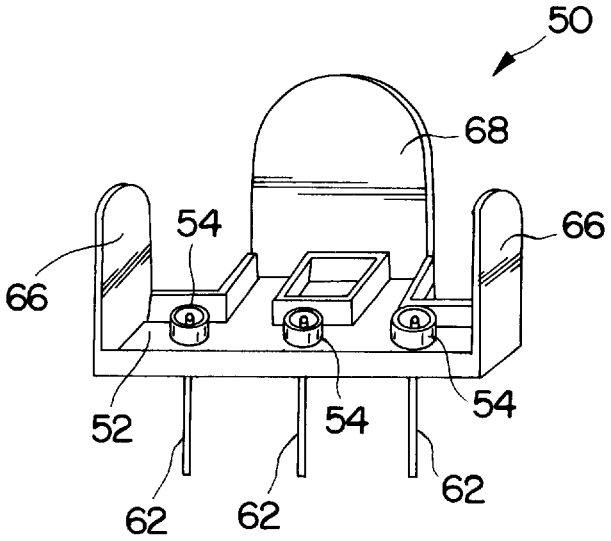
FIG. 5 shows an ink refill adapter according to one embodiment of the present invention.
Figure 10:
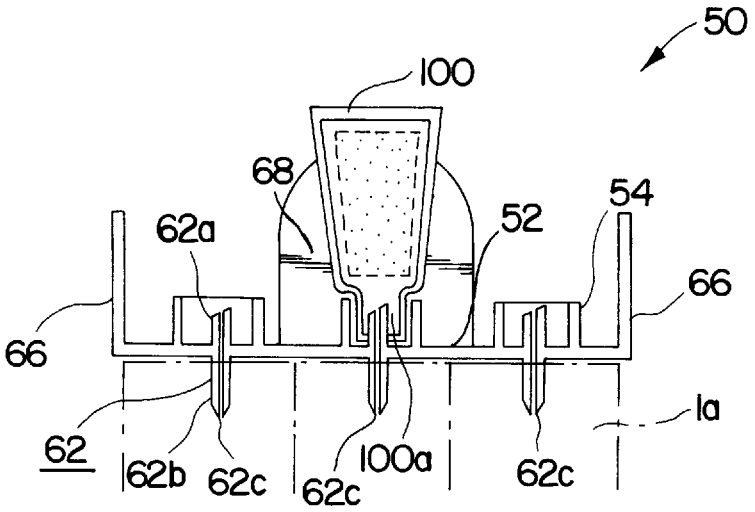
FIG. 10 is the ink refill adapter of FIG. 5 set on the main section of the cartridge.

The ink refill adapter 50 which is used together with the ink refill station 12 is, as shown in FIG. 5, include a base plate 52 which is provided with three ink container holders 54. The base plate 52 is of a size that can cover the surface area of the cartridge holding space 18. The ink container holders 54 provided on the base plate 52 are cylinders equally spaced from each other, and each one of the ink container holder 54 has at its center an ink transfer needle 62. The needles 62 penetrates the base plate 52 of the ink refill adapter 50, thus having, as best seen in FIG. 10, upper sections 62*a* and lower sections 62*b*. Each one of the needles 62 has a central through hole 62*c* that extends all the way from the upper end to the bottom end of the needle 62, and both ends of each one of the needles 62 are formed pointed.

Figure 6:
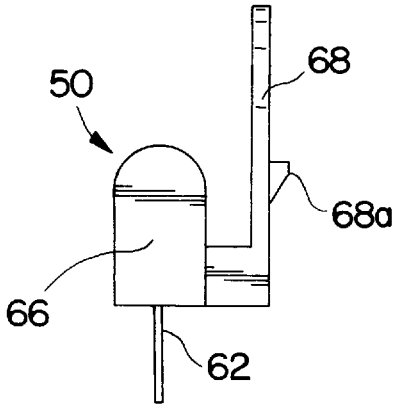
FIG. 6 is a side view thereof.

The ink refill adapter 50 is further provided with a pair of side walls 66 and a rear wall 68 which extend upwardly from the side edges and rear edge of the base plate 52, respectively. The rear wall 68 is, as best seen in FIG. 6, provided with a positioning projection 68*a*. The positioning projection 68*a* projects from the outer or back surface of the rear wall 68 and has a size that can snugly fit in the positioning opening 14*a* formed in the extended plate section 14 of the main box 12.

Figure 12:
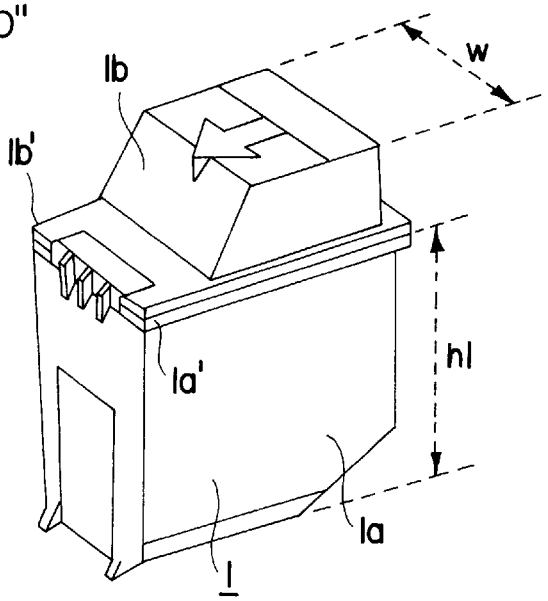
FIG. 12 PRIOR ART
FIG. 12 shows one type of ink cartridge of the prior art.
Figure 13:
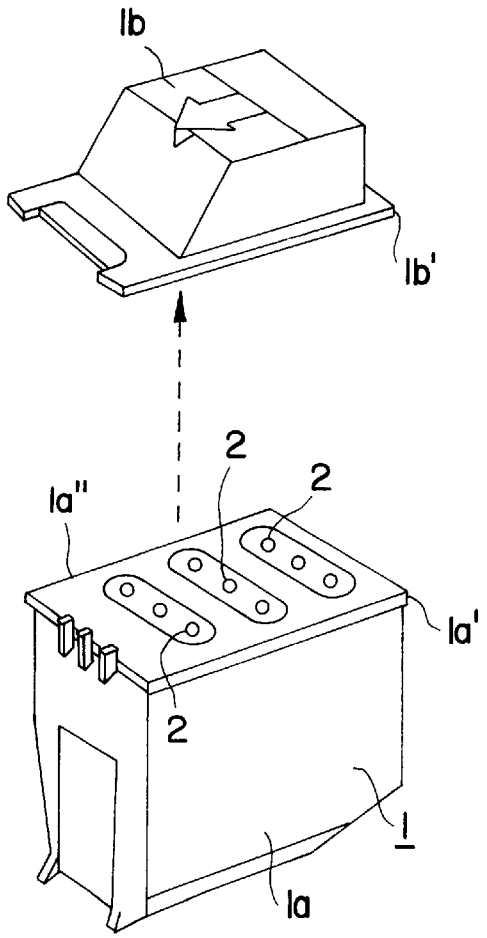
FIG. 13 PRIOR ART
FIG. 13 shows the head section and the main section of the cartridge of FIG. 12 which are separated from each other.

With the structures described above, a used and empty color ink cartridge 1, as show in FIG. 12, is placed inside the cartridge holding space 18. It is preferable to put a safety band around the refill station 10 and over the ink cartridge so as to secure the cartridge inside the cartridge holding space 18. When main section 1*a* of the cartridge 1 is completely placed inside the cartridge holding space 18, the flange 1*a*' of the main section 1*a* of the cartridge 1 rests on the top surfaces 16*a* of the ribs 16 of the main section body 12 as shown in FIG. 2.

Then, the pushing screw 40 is turned by hand in one direction so as to advance the tip end 44*a* of the screw 40 to the head section 1*b* of the cartridge 1. The advanced tip end 44*a* of the screw comes into contact with the side or the upper area of the head section 1*b* ; and when the screw 40 is further turned, the tip end 44*a* pushes off the head section 1*a* from the cartridge main section by the advancing movement of the pushing screw 40. With this pushing force of the screw 40, the head section 1*b* glued to the main section is separated as shown by the dotted line in FIG. 2.

Figure 7:
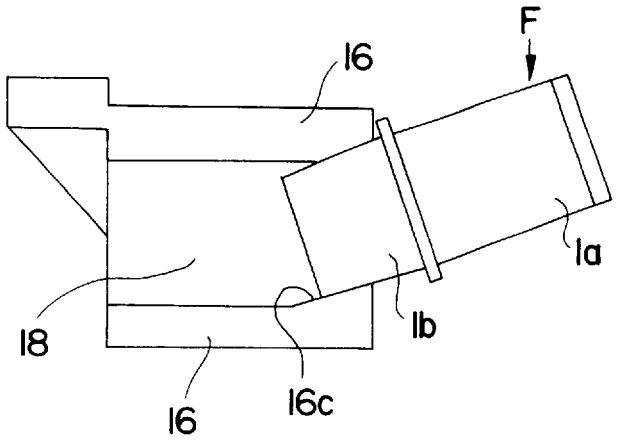
FIG. 7 illustrates a method of snapping off of the head section from the main section of the cartridge according to the present invention.

In case the head section 1*b* is not completely separated from the main section 1*a*, the cartridge 1 is removed from the cartridge holding space 18, and the head section 1*b* of the cartridge 1 is brought between the slanted surfaces 16*c* of the bottom area of the ribs 16 after the main box 12 is set sideways as shown in FIG. 7. After this, a pressing force F is applied to the main section 1*a* of the cartridge 1 so that the head section 1*b* held between the slanted surfaces 16*c* of the ribs 16 is snapped off from the main section 1*a*, thus separating the head section 1*b* from the main section 1*a*.

Figure 8:
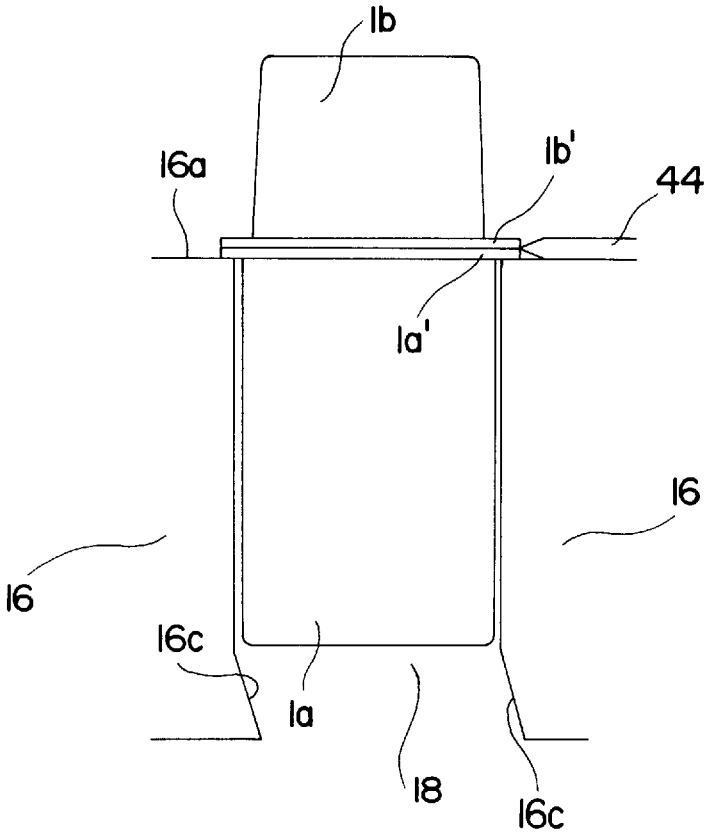
FIG. 8 is an schematic view showing the ink cartridge placed on the ribs of the ink refill station of FIG. 4.

In the embodiment shown in FIG. 4, the extended plate section 14 of the main box 12 has a pair of screws 40' and 40", each having a pointed end 44*a*'; and as shown in FIG. 8, these screws 40' and 40" are provided, height-wise in the main box 12, so that when the screws 40' and 40" are rotated, the pointed ends 44*a*' advance, come into contact with and penetrate into the seamed area between the glued flange 1*a*' and 1*b*' of the main section 1*a* and head section 1*b*, where the main section 1*a* and the head section 1*b* are attached together, so that the pointed end 44*a*' applies a shearing force to the seamed area, thus separating the head section 1*b* from the main section 1*a*. When the two screws 40' and 40" are turned, it is preferable to turn them by turns so that shearing force can be applied evenly onto two (2) points of the seamed area of the cartridge 1. In this embodiment as shown in FIG. 4, however, only one screw (either 40' or 40") that has a pointed tip end can be used. In this case, such a single pointed-end screw is provided in one of two threaded holes 30' and 30" or in a threaded hole 30'" which is provided above the rib 16" located at the center of three (3) ribs 16 formed on the rear wall 12*c*.

During the above-described head separation process using the screw or screws, it is possible to take out the cartridge out of the cartridge holding space 18 and then put it back in the space 18 after turning around the cartridge so that the other side of the head section 1*b* or the seamed area faces the tip end(s) of the screw(s).

When the head section 1*b* is thus separated from the main section 1*a* by the screw(s) 40, the main section 1*a* remains upright inside the cartridge holding space 18. When the head section 1*b* is removed by way of the method shown in FIG. 7, the main section 1*a* having no head section 1*b* thereon is put back in the cartridge holding space 18 (by hand) so that the flange 1*a*' is on the upper surfaces 16*a* of the ribs 16.

After the main section 1*a* is thus set upright in the cartridge holding space 18, the pushing screw(s) 40 is turned in another direction so that the tip end 44*a* is retrieved from above the cartridge holding space 18.

Figure 9:
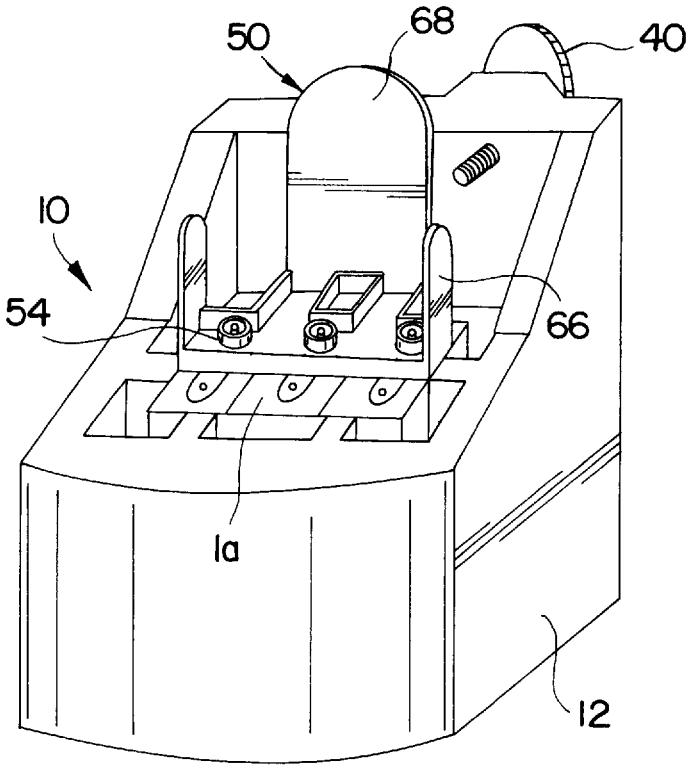
FIG. 9 shows the ink refill station of FIG. 1 with the main section of the cartridge therein and the ink refill adapter placed on the main section of the cartridge.

Then, the ink refill adapter 50 is placed on the main section 1*a* of the ink cartridge 1 and pressed downward, so that the pointed ends of the lower portions 62*b* of the ink transfer needles 62 are brought into the ink reservoirs inside the main section 1*a* as shown in FIG. 9.

After the needles 62 are brought into the ink reservoirs, an ink container 100 is set into one of the ink container holders 54 as shown in FIG. 10. In other words, the ink-outlet 100*a* of the ink container 100 is pushed into the pointed end of the upper portion 62*a* of the ink transfer needle 62 so that the pointed end of the upper portion 62*a* penetrates the ink outlet 100*a* into the ink container 100. By squeezing the ink container 100, the ink inside the ink container 100 is transferred into the reservoir through the central hole 62*c* of the needle 62. This ink transfer will be done for three times so that all of three reservoirs are filled with red, blue and yellow ink if all of the color ink has been used up. In deed, only one or two ink can be refilled after determining which color(s) should be refilled.

After the ink filling is thus completed, the head section 1*b* is put back on the main section 1*a* and secured thereon by an adhesive tape so that the refilled cartridge 1 is ready to be installed back in a printer.

Figure 11:
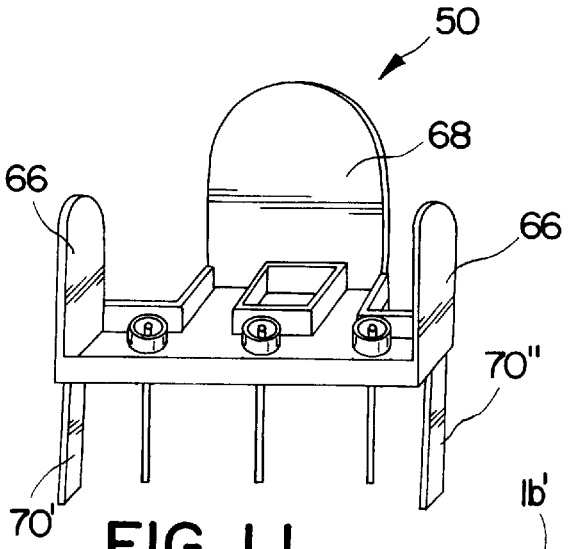
FIG. 11 shows another type of ink refill adapter according to another embodiment of the present invention.

FIG. 11 shows a different type of ink refill adapter 50. This adapter 50 has two legs 70' and 70" extending from the lower edges of the side walls 66 of the adapter 50. The legs 70' and 70" are snugly brought into the space, as shown by the dotted lines in FIG. 4, formed between two ribs 16 formed on the inner surface of the side wall 12*c*' and 12*c*" of the main box 12. Thus, when the leg-equipped adapter 50 is used, the adapter can be more securely placed on the main section 1*a* of the cartridge 1 by the legs 70' and 70" which are held between two ribs 16. In this case, if one of the legs 70' is made smaller in width than the other leg 70" as shown FIGS. 4 and 11, and the space between one pair of two ribs 16 on the inner surface of one side wall 12*c*' is formed smaller than that of another pair of two ribs 16 on the inner surface of the other side wall 12*c*" as shown in FIG. 4, the positioning of the adapter 50 can be performed easily. Though not shown, a positioning projection may be formed on the rear wall 68 of the adapter 50' of FIG. 11.

When the adapter 50 is placed on the main box 12, the positioning projection 68*a* formed on the rear wall 68 is snugly engaged with the positioning hole 14*a*. Thus, it is possible to prevent the adapter 50 from making an inadvertent movement which might cause spillage of the ink during the ink refill process. This is more clear for the adapter shown in FIG. 5, which has no legs as in the adapter shown in FIG. 11.

As seen from the above, according to the present invention, the head section of the used ink cartridge can be easily removed from the main section in the ink refill station; and with the use of the ink refill adapter, ink can be refilled in the reservoirs of the inside of the main section of the cartridge which is set inside the ink station smoothly, without causing spillage of the ink.

I claim:

1. An apparatus for refilling an ink cartridge which comprises a main section having therein an ink reservoir and a head section attached to said main section, said apparatus comprising:

an ink refill station having an empty space therein so as to accommodate said main section of said ink cartridge in said empty space, said ink refill station being provided with at least one separation means for separating said head section from said main section; and an ink refill adapter comprising a base plate which covers said empty space of said ink refill station, said ink refill adapter having at least one ink transfer means provided in said base plate so as to connect an ink container to said ink reservoir of said ink cartridge.

2. An apparatus for refilling ink in an ink cartridge used in ink-jet printers, said ink cartridge comprising a main section having therein a plurality of ink reservoirs and a head section attached to said main section, said refilling apparatus comprising:

an ink refill station which is substantially in a box shape with an empty space therein so as to accommodate said main section of said cartridge in said empty space, said ink refill station being provided with a plurality of longitudinal ribs formed on an inner surface that defines said empty space and provided with at least one separation means for separating said head section from said main section of said cartridge; and an ink refill adapter to be fitted on one end surface of said main section of said ink cartridge accommodated in said empty space of said ink refill station, said ink refill adapter having a plurality of ink transfer means for connecting ink containers and said ink reservoirs.

3. An apparatus according to claim 2, wherein said separation means is a threaded screw provided in a threaded hole formed in an extended plate section of said ink refill station.

4. An apparatus according to claim 3, wherein said ink refill adapter is further provided with a pair of legs that are inserted into spaces formed between said ribs of said ink refill station.

5. An apparatus according to claim 2, wherein a tip end of said at least one separating means is provided so as to come into contact with an upper end area of said head section of said cartridge.

6. An apparatus according to claim 2, wherein a tip end of said at least one pressing means is provided so as to come into contact with a seamed area where said head section and said main section of said cartridge are attached together.

7. An apparatus according to claim 2, further comprising slanted surfaces provided on said ribs so that said main section of said ink cartridge is held between said slanted surfaces.

8. An apparatus for holding an ink cartridge used in ink-jet printers, said ink cartridge comprising a main section having therein a plurality of ink reservoirs and a head section attached to said main section, characterized in that said apparatus is substantially a box with an empty space therein so as to accommodate said main section of said cartridge in said empty space, said box being provided with a plurality of longitudinal ribs formed on an inner surface that defines said empty space and provided with at least one separation means for separating said head section from said main section of said cartridge and further comprises slanted surfaces provided on said ribs so that said main section of said ink cartridge is held between said slanted surfaces.

9. An apparatus according to claim 8, wherein said separation means is a threaded screw provided in a threaded hole formed in an extended plate section formed on said box.

10. An apparatus according to claim 8, wherein a tip end of said at least one separating means is provided so as to come into contact with an upper end area of said head section of said cartridge.

11. An apparatus according to claim 8, wherein a tip end of said at least one separating means is provided so as to come into contact with a seamed area where said head section and said main section of said cartridge are attached together.

12. A method for refilling ink into an ink cartridge which comprises a main section having an ink reservoir therein and a head section attached to said main section, said method comprising the steps of:

placing said ink cartridge into an empty space of an ink refill station which is substantially a box having said empty space therein so as to accommodate said main section of said cartridge in said empty space, said ink refill station being provided with a plurality of longitudinal ribs formed on an inner surface that defines said empty space and provided with at least one separation means;

operating said separation means so as to come into contact with said cartridge, thus separating said head section from said main section so that said main section of said ink cartridge remains in said ink refill station;

placing an ink refill adapter on a top end of said main section of said ink cartridge which is in said ink refill station so that one end of an ink transfer means provided in said ink refill adapter is inserted in an ink reservoir of said main section of said ink cartridge; and connecting an outlet of an ink container to another end of said ink transfer means so that ink contained in said ink container is transferred from said ink container into said ink reservoir.

13. A method according to claim 12, further comprising a step comprising holding said head section of said ink cartridge between slanted surfaces which are formed on said longitudinal ribs, pressing said main section of said ink cartridge so as to separate said head section from said main section, and then placing said main section of said ink cartridge in said ink refill station, said step being taken before said step of placing said ink refill adapter on said top end of said main section of said ink cartridge.

14. A method according to claim 12, wherein a tip end of said separating means comes into contact with an upper end area of said head section of said cartridge.

15. A method according to claim 12, wherein a tip end of said pressing means comes into contact with and penetrates into a seamed area where said head section and said main section of said cartridge are attached together.

* * * * *